US009656133B1

(12) United States Patent
Chalifoux

(10) Patent No.: US 9,656,133 B1
(45) Date of Patent: May 23, 2017

(54) EXPANDING GOLF GRIP CORE

(71) Applicant: Paul Chalifoux, Naples, FL (US)

(72) Inventor: Paul Chalifoux, Naples, FL (US)

( * ) Notice: Subject to any disclaimer, the term of this patent is extended or adjusted under 35 U.S.C. 154(b) by 0 days.

(21) Appl. No.: 15/287,438

(22) Filed: Oct. 6, 2016

(51) Int. Cl.
*A63B 53/14* (2015.01)
*A63B 60/14* (2015.01)
*A63B 60/52* (2015.01)

(52) U.S. Cl.
CPC ..... *A63B 53/14* (2013.01); *A63B 60/14* (2015.10); *A63B 60/52* (2015.10)

(58) Field of Classification Search
CPC ..... A63B 53/14; A63B 60/52; A63B 60/14
See application file for complete search history.

(56) References Cited

U.S. PATENT DOCUMENTS 2,103,889 A * 12/1937 Brisick ..... A63B 53/14 473/303
3,915,021 A * 10/1975 Schwartz ..... B23B 31/40 473/300
4,347,776 A * 9/1982 Grass ..... G10D 9/02 84/383 R
4,689,858 A * 9/1987 Barber ..... A44B 11/04 24/17 B
5,024,438 A * 6/1991 Candow ..... A63B 53/06 135/76
5,524,885 A * 6/1996 Heo ..... A63B 49/08 473/298
5,584,482 A * 12/1996 Huang ..... A63B 49/08 473/301
5,653,643 A * 8/1997 Falone ..... A63B 53/14 473/300
5,728,023 A * 3/1998 Green ..... F16G 1/22 474/206
5,730,662 A * 3/1998 Rens ..... A63B 60/08 16/DIG. 12
5,944,617 A * 8/1999 Falone ..... A63B 53/14 473/300
6,656,057 B2 * 12/2003 Manual ..... A63B 53/14 473/300
6,837,812 B2 * 1/2005 Falone ..... B25G 1/01 2/267
7,013,533 B2 * 3/2006 Lumpkin ..... B62K 21/26 16/421
7,118,598 B2 * 10/2006 Michelson ..... A61F 2/4455 623/17.11
7,806,600 B2 * 10/2010 Marrs ..... G02B 6/3802 385/55
8,177,658 B1 * 5/2012 Johnson ..... A63B 53/14 473/297
8,337,322 B2 * 12/2012 Harper ..... A63B 57/50 473/286
8,419,566 B2 * 4/2013 Gill ..... A63B 53/14 473/299
8,572,818 B2 * 11/2013 Hofmann ..... B60R 13/0206 24/297

(Continued)

FOREIGN PATENT DOCUMENTS

GB 278142 A * 10/1927 ..... A63B 53/02
GB 313337 A * 6/1929 ..... A63B 53/00

(Continued)

*Primary Examiner* — Stephen Blau

(57) ABSTRACT

A golf grip core designed to expand over a golf shaft for easy placement.

18 Claims, 9 Drawing Sheets

(56) References Cited

U.S. PATENT DOCUMENTS

| | | | | | |
|---|---|---|---|---|---|
| D709,345 | S * | 7/2014 | Reitano | B25G 1/102 | D8/107 |
| 2002/0022533 | A1* | 2/2002 | Churovich | A63B 53/14 | 473/296 |
| 2007/0111815 | A1* | 5/2007 | Cheng | A63B 53/10 | 473/300 |
| 2012/0142444 | A1* | 6/2012 | Chol | A63B 53/10 | 473/296 |
| 2013/0344977 | A1* | 12/2013 | Chalifoux | A63B 53/16 | 473/299 |
| 2015/0231462 | A1* | 8/2015 | Chapin | A63B 60/34 | 473/300 |
| 2015/0251064 | A1* | 9/2015 | Chapin | A63B 53/14 | 473/297 |

FOREIGN PATENT DOCUMENTS

| | | | | |
|---|---|---|---|---|
| GB | 352462 A * | 7/1931 | A63B 53/14 | |
| GB | 413396 A * | 7/1934 | F16M 11/24 | |

* cited by examiner

EXPANDING GOLF GRIP CORE

BACKGROUND OF THE INVENTION

Field of the Invention

The present invention refers to a method allowing quick placement and quick removal of golf grips onto a golf club. Quick change of golf grips allow golfers to try different golf grips on golf clubs before purchasing one. Quick change of golf grips further allows easy replacement of worn golf grips. Present methods to change a golf grip requires cutting off a golf grip, removing adhesive tape, reapplying adhesive tape, applying a slippery agent such as acetone and sliding on a new grip.

An internal core within a golf grip allows a grip to slide easily onto a golf club shaft. A golf grip must slide onto a golf shaft and be stiff enough to resist twisting and rotational movement. Present golf grip cores are not rigid for this reason. A non-rigid golf core using adhesion to a golf shaft to prevent twisting and rotational movement. A rigid core does not adapt to different golf shaft shapes.

The present invention further allows perfect placement of a golf grip. If a golf grip is placed onto a golf club shaft and it is discovered to be misaligned, it is easily repositioned. It is further designed to allow different placement that makes a golf club longer or shorter.

Description of Concurrent Art

Golf grips aid a golfer in holding a golf club. Golf clubs include drivers, woods, irons, wedges and putters. Present grips come in a wide variety of sizes, shapes, colors, materials, textures, tapers, and the like. It is difficult to evaluate which grip fits a golfer's hand best and works best as a golfer cannot try them on a golf club and strike balls. Presently, a golfer evaluates how a grip feels in their hand with no golf club attached to the grip. If a golfer likes the feel of a grip in their hand, the grip is permanently attached to a club. If grips are attached to a golfer's clubs and they do not like them, it is an expensive and time consuming process to replace them. If a golf grip is positioned such that the golfer does not like the position, it cannot be changed.

Present technology to change a golf grip requires cutting off a golf grip, removing adhesive tape, reapplying adhesive tape, applying a slippery agent such as acetone and sliding on a new grip. The process is complex enough that most golfers do not change their own grips but have professionals do it for them. Professional regripping is expensive and time consuming. The process makes it difficult for a golfer to effectively evaluate grips. Present golf grip core structures do not adapt to different shaft shapes.

It would be advantageous to have grips that simply slide onto a shaft, are rigid to resist twisting, provide some adherence during use and adapt to different shaft shapes. It would be advantageous to have a technique that allows grips to be placed and removed in seconds for better selection at point of purchase and ease of replacement. It would be further advantageous for a golfer to be able to adjust a grips position as required to perfect alignment with the club head or adjust a club length.

Present golf grips are solid rubber. The outer surface is often modified for appearance or identification by printing directly on rubber or printing on a rubber sheet and adding it over the surface. Present core structures used with golf grips are a solid structure. In one version, a core is adhered onto a golf shaft and interchangeable golf grips built over a matching core. The inside core cannot adapt to different shaft shapes resulting in fracture at time of placement or during use.

Present golf grips are adhered to a golf shaft using double sided adhesive tape. Tape is applied to a golf shaft. A slippery agent is placed onto the tape. A golf grip is placed onto the shaft while the slippery agent is present. The slippery agent evaporates quickly so a golfer must work quickly and hope golf grip alignment and general placement is correct. Adhesive technology provides resistance to forces placed onto a grip shaft interface so a golf shaft does not move within a grip during use.

A golf grip is constructed with elastomeric materials. Compressive force from grip expansion and frictional resistance of a grips inner surface onto a golf shaft determines how much force is required to place a grip onto a shaft. Force required for grip placement is altered by grip inner diameter, altered elasticity of grip material or utilization of slippery agents such as acetone on adhesive tape.

Previous patents reveal splits in a shaft to aid in expansion. The splits are usually the full length of a core. The long splits of these patents do not allow full adaptation as variation in diameter occurs on a shaft but the core diameter stays the same throughout. The present invention allows differential expansion and therefore different diameters along its length. In addition, open slots with rubber material extending into them are used in advanced versions.

SUMMARY OF THE INVENTION

The instant apparatus and system, as illustrated herein, is clearly not anticipated, rendered obvious, or even present in any of the prior art mechanisms, either alone or in any combination thereof. A versatile system, method and series of apparatuses are revealed for creating interchangeable grips utilizing a central core in a golf grip that adapts to various shaft shapes and differential diameters.

In the preferred embodiment, golf grips consist of a core which is surrounded by rubber, plastic or like materials to form a grip. The core is constructed of plastic, metal, rubber, ceramic, wood or any other common materials or combinations of materials. Outside materials form the individual shape, texture, color and the like.

The core fits over a golf club shaft. In the preferred embodiment, it expands over a shaft as it slides down to a final position. The core may be passive but in the preferred embodiment, it maintains constant compression onto a golf shaft. The resulting friction helps stabilize a grip. The upper central hole runs parallel to reflect the parallel shaft portions and then the remainder tapers to match the general tapered form of a taper or stepped shaft.

Rubber material extends through open slots in advanced versions. Pressure onto the grip surface forces rubber onto a golf shaft to create increased friction and resistance to movement. Rubber into open slots minimizes movement of slots cut edges sliding along the surfaces.

The core is constructed inside a golf grip and is placed directly onto a golf shaft. Alternatively, core material is constructed inside a golf grip such that the core material does not touch the shaft. The core provides reinforcement to minimize bending of grip material.

Golf club shafts vary in diameter at the butt end. The butt end is 0.560, 0.580, 600, or 0.620 inches in the most commonly manufacturer shafts. The diameter of a golf shaft changes going down toward the club head. In the preferred embodiment, the core expands to fit onto a shaft by material elasticity and or by core structural design. Present core structures cannot do this.

A golf grip expands during placement and remains expanded when fully placed. The inside of the golf grip is smaller than the outside diameter of a golf club shaft. The resulting compression provides resistance to movement. Friction onto a golf shaft resulting from grip compression provides resistance to movement. Compression of hand pressure onto rubber further improves compression during a golf swing. The golf grip fits securely with compression however; it is not secure enough that movement would not occur during use. The grip is fixed securely with a compression unit. Resistance from core compression is weak enough to allow grip placement. A grip is not secure enough to play golf without securing a compression unit. In one alternative, a weak restickable adhesive lines the inside of a core.

In an advanced version, a compression unit is not required as hand pressure forces an internal adhesive rubber onto a golf shaft through the slots filled with the material.

To augment grip stability, a compression component extends into a golf club shaft or applies force from the outside. The compression component is joined to the grip core either directly or through intermediate materials such as the grip rubber. The compression component and core provide adequate force to secure a grip to a golf club.

Golf shafts have many shapes and many different diameters. Golf grips are constructed of elastic materials allowing expansion. Expansion of a golf grip allows them to be placed onto shafts of different diameter and different diameters within the same golf shaft. Adhesive tape holds a golf grip onto a golf shaft to resist grip movement including rotation, twisting, dislodgment and impaction. Adhesive tape technology makes golf grip replacement or adjustment difficult.

It would be desirable to have a golf grip that does not use adhesives to secure it onto a golf club shaft. It would be desirable to have a golf grip that is easily adjustable for perfect placement and alignment. It would be further desirable to have a golf grip that can lengthen or shorten a golf club length. An expandable core design provides a solid feel by adapting tight to a shaft throughout its length. The golf grip further resists twisting and movement.

A core placed within a golf grip controls grip expansion and an inner surface that provides proper friction onto a golf shaft. Core material is stiff enough to resist grip twisting. A stiff material minimizes expansion so overlapping slots are used as a release for segmental expansion.

Golf shafts vary in diameter. For example, most common golf shafts are 0.560, 0.580, 0.600 or 0.620 inches in diameter. Golf shaft vary in diameter throughout their length. It is common for the first few inches to be parallel. The remainder of a golf shaft tapers or steps down to a reduced diameter. A golf grip is commonly 10 inches. The diameter 10 inches down a golf shaft from the butt end is about 0.08 inches less than the top of the shaft. For a golf grip to fit tight with compression onto a golf shaft, it must taper down or be generally smaller at its end. A core with a smaller end must expand over a golf club shaft end. Slots and an internal bevel are used for core placement.

A core with a cylindrical shape expands easier with a split down its side. A cut extending the full length of a core from top to bottom allows sliding of cut edges and core twisting. To minimize twisting, two offset cuts are used. A cut starts at one end of a core while a separate cut starts at the other end. Each cut extends beyond the other and do not meet as they are offset. For example, each cut may extend beyond the core midpoint. The overlap may occur shorter or longer than the midpoint. In the preferred embodiment, many overlapping cuts or slots are used and most do not extend to the end of the core.

In the preferred embodiment, a solid core is used and a rubber sheet of about 0.08 inch thickness is glued over it. The thin rubber cover allows expansion. At the butt end of the core, two horizontal cuts start from the end and extend past the midpoint. At the far end of the core, four cuts are used preferably offset 45 degrees to the horizontal butt end cuts and extend past the midpoint. Slices or open slots can be used. The present design allows slight expansion over the butt end as there is little variation when being placed while the distal end expands dramatically to go over the larger butt end. Small extensions are placed at the end of the core. These extensions are covered with a rubber piece. The rubber end allows controlled expansion and more even distribution of forces onto the core. In general, in the preferred embodiment, there are no slots on the very top surface which helps to maintain strength and keeps an even appearance.

When there is separation between the cut surfaces, it is a slot. Either a cut or slots are used but for purposes of explanation, only slots will be referred to. It is understood that a cut may be used instead of a slot.

An outside grip component is molded directly onto an inner core or manufactured separately and secured with adhesives, snaps, friction or like methods. Components can be constructed with various coatings or layers such as rubber.

The foregoing has outlined the more pertinent and important features of the present invention in order that the detailed description of the invention that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

There has thus been outlined, rather broadly, the more important features of the versatile expanding golf grip core system and series of accompanying systems and apparatuses and embodiments in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

To the accomplishment of the foregoing and related ends, certain illustrative aspects are described herein in connection with the following description and the annexed drawings. These aspects are indicative of the various ways in which the principles disclosed herein can be practice and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

The advantages of the present apparatus will be apparent from the following detailed description of exemplary embodiments thereof, which description should be considered in conjunction with the accompanying drawings, in which: Having thus described the system in general terms, reference will now be made to the accompanying drawings, which are not necessarily drawn to scale, and wherein.

DETAILED DESCRIPTION OF THE PREFERRED EMBODIMENTS

Figure 1:
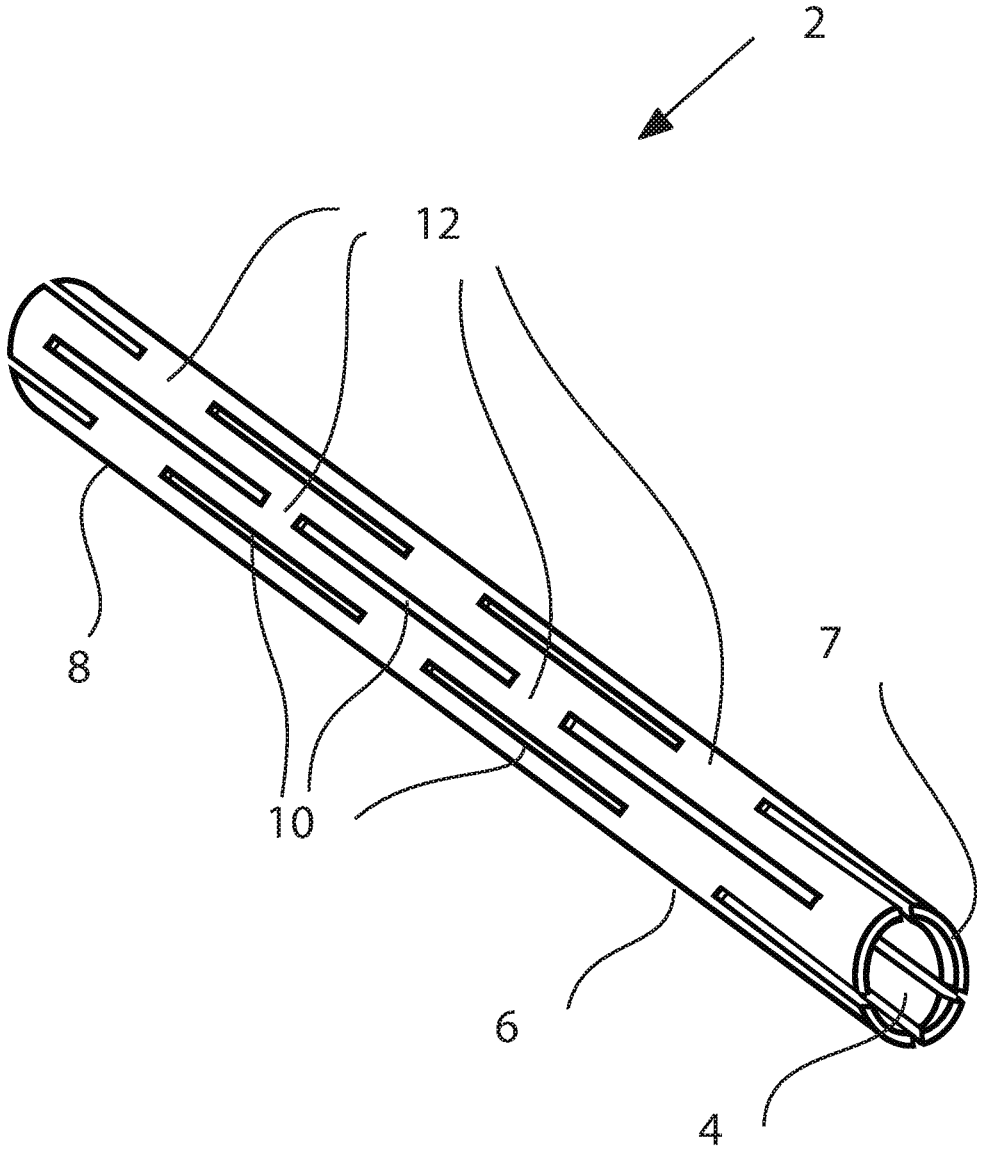
FIG. 1 illustrates an isometric view of a golf grip core.

Referring to FIG. 1, core 2 has end 8 and end 6 with opening 4 to accept a golf shaft. Opening 4 has an inner tapered end 7 to guide a shaft into position. Alternatively, rubber extends into this area forcing it outward to expand onto a shaft. Slots 10 allow expansion such that area 12 moves outward when a larger diameter shaft is used.

Area 12 is at the end of each slot. Area 12 has slots on either side. The formation of slots allows area 12 to move in or out depending on the diameter of a shaft with the core. Slots 10 may be open or filled with rubber material. When retention of the grip to core interface are improved and there twisting of the grip is reduced.

In general, a golf shaft is the same diameter for the first few inches starting the butt end and going down the shaft. The sides run parallel for the first few inches. The shaft then tapers or steps down and reduces shaft diameter. The core may be tapered from one end to the other or parallel and tapered at opposite ends. End 8 to end 6 of core 2 is tapered from one end to the other. Alternatively, the core is parallel at end 8 and after a few inches tapers to end 6.

Slots at each end of core 2 allow expansion. Length of these slots must be long enough to allow adequate expansion so core 2 can slide onto a golf shaft. For example, the opening 4 has an inner diameter of 0.500 inches. A golf shaft of 0.600 inches requires expansion of core 2 by 0.100 inches. Slots 10 may be all the same length and spacing or variable throughout a core length.

In the preferred embodiment, the top of a golf grip core does not contain slots to provide rigidity and resistance to twisting and rotation.

Figure 2:
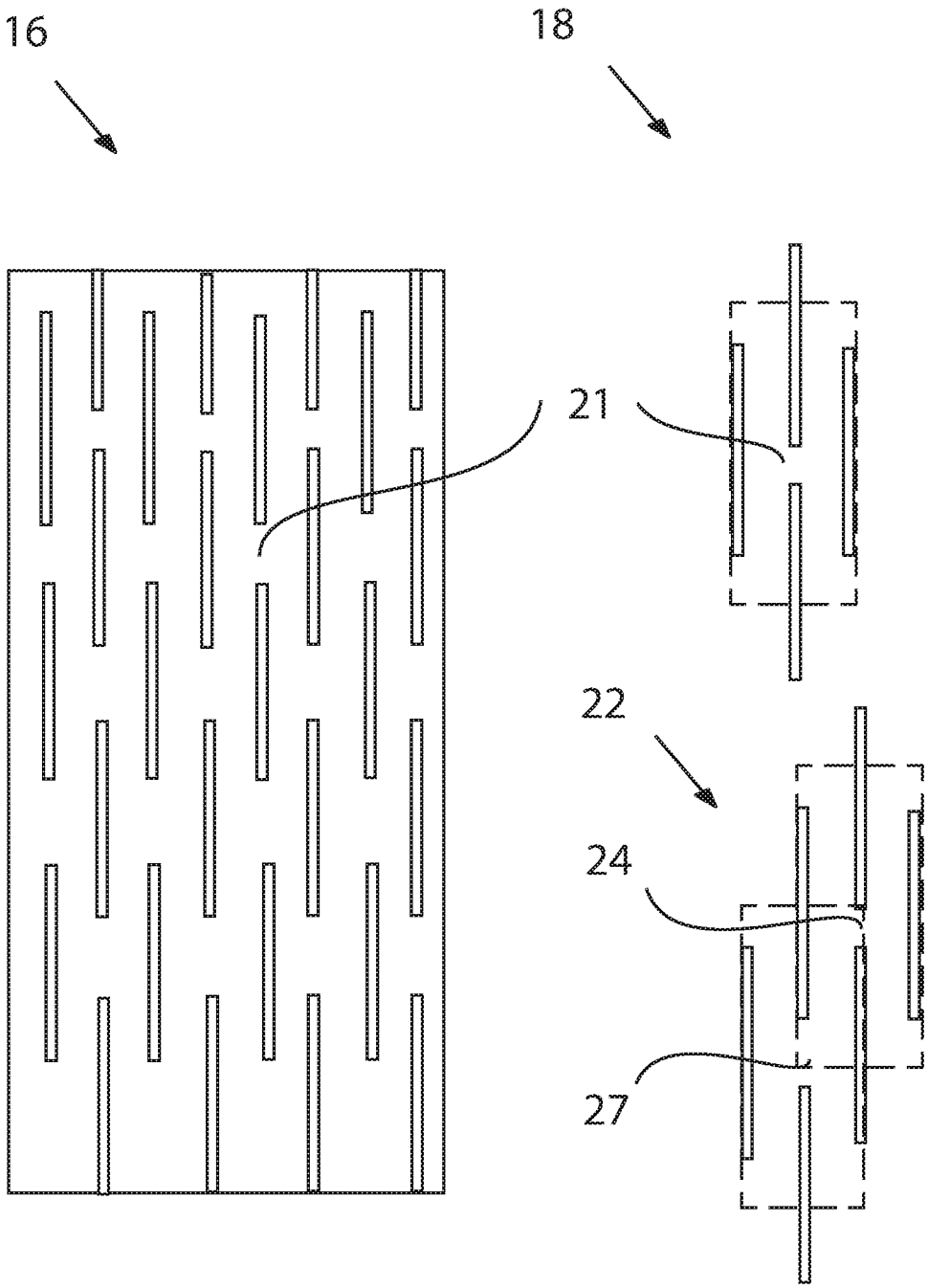
FIG. 2 illustrates a cross section view of a core open and laid flat.

Referring to FIG. 2, a cross section view of a core 16 and segment 18 are opened and laid flat is shown for explanation. At the end of each slot is a solid area 21 between it and the next slot. There are slots on either side of this solid area. Area 21 is between two slots in both the horizontal and vertical directions. The slot formation allows area 21 to move outward and inward resulting in different core diameters as required by the underlying shaft diameter. Section 22 shows the combination of slots resulting in two solid areas 24 and 27 which expand as needed. Each row of slots overlap with adjacent row of slots in height along the length of a core allowing differential expansion throughout its length.

Figure 3:
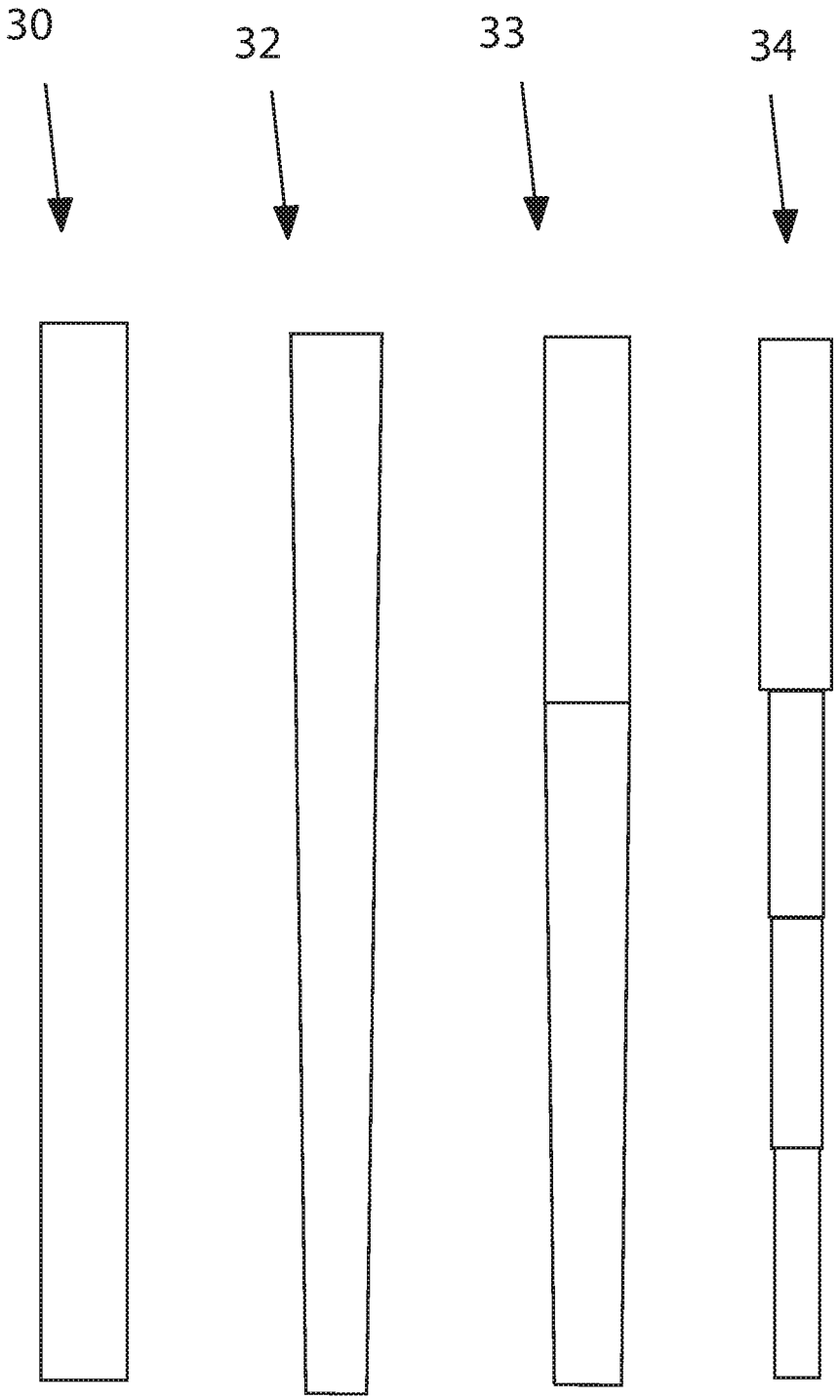
FIG. 3 illustrates a cross section view of different golf shafts.

Referring to FIG. 3, the grip end sections of various golf shaft shapes are shown. Grip 30 is parallel. Grip 32 is tapered. Grip 33 starts parallel and turns tapered part was down. Grip 34 is parallel and then steps down. A golf grip must adapt to each shaft or a secure fit. Variable amounts of expansion are required of a core as described in this invention.

Figure 4:
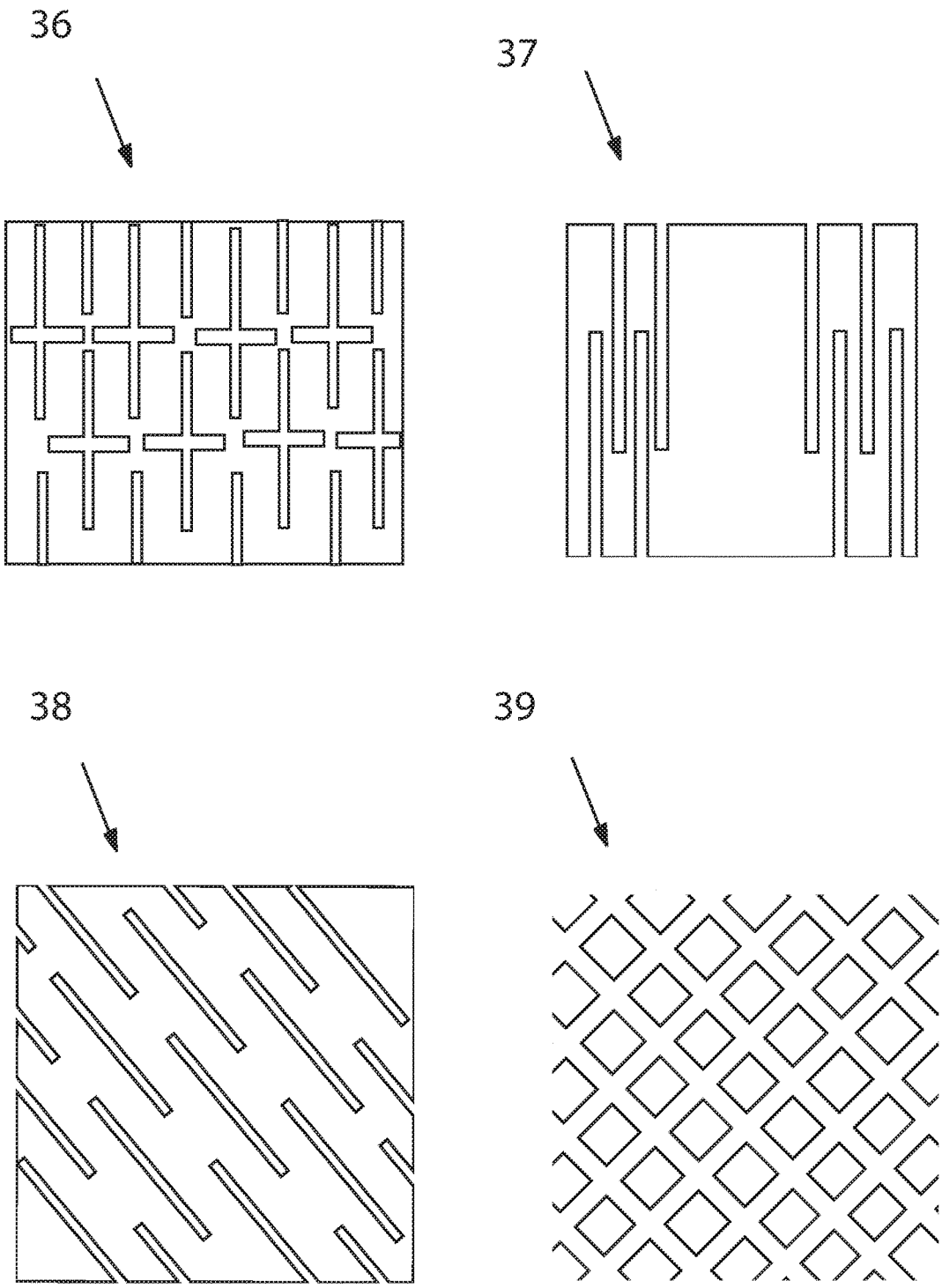
FIG. 4 illustrates a cross section view of cores open and laid flat.

Referring to FIG. 4, cross section view of various slot patterns used on a core is shown. Slot pattern 36 uses cross shaped slots. Slot pattern 38 uses angled slots. Slot pattern 39 used square slots which may be angled or straight. Slot pattern 37 occurs only on the side and or bottom of a core. The top section remains solid. Alternatively, the bottom may remain solid with no slots.

Figure 5:
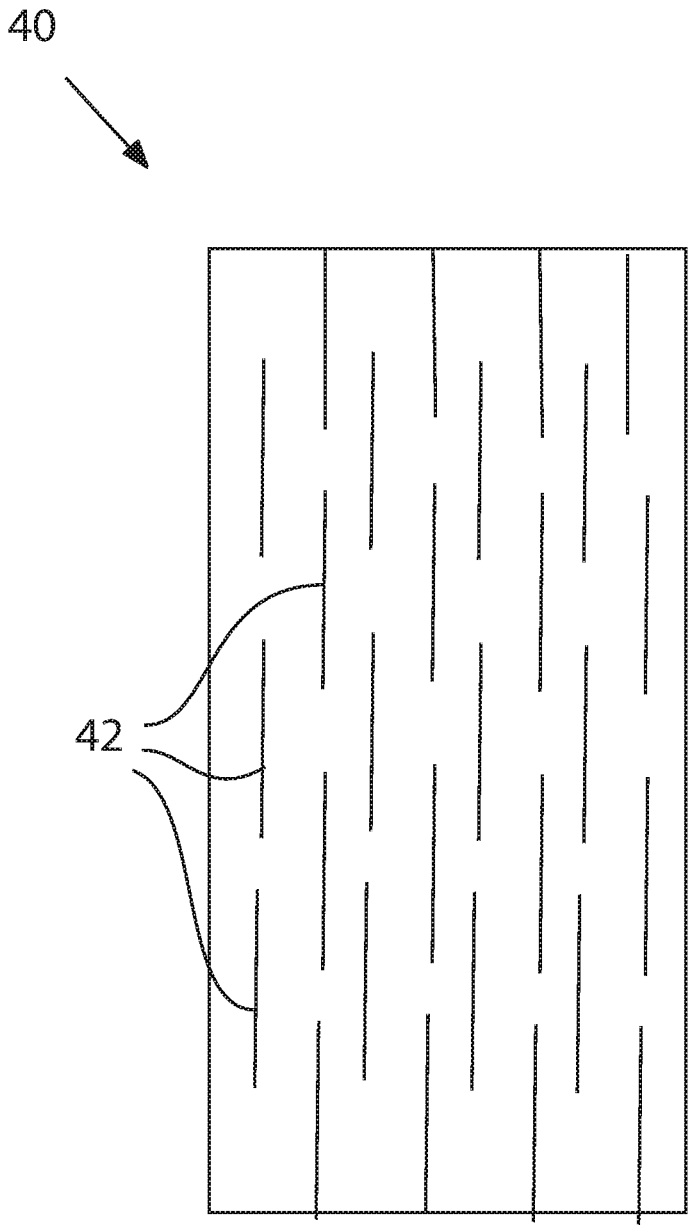
FIG. 5 illustrates a cross section view of a core open and laid flat.

Referring to FIG. 5, a cross section view of a core 40 opened and laid flat is shown. Core 40 used slices 42 for expansion. There are no open slots. Slices may be combined with open slots.

Figure 6:
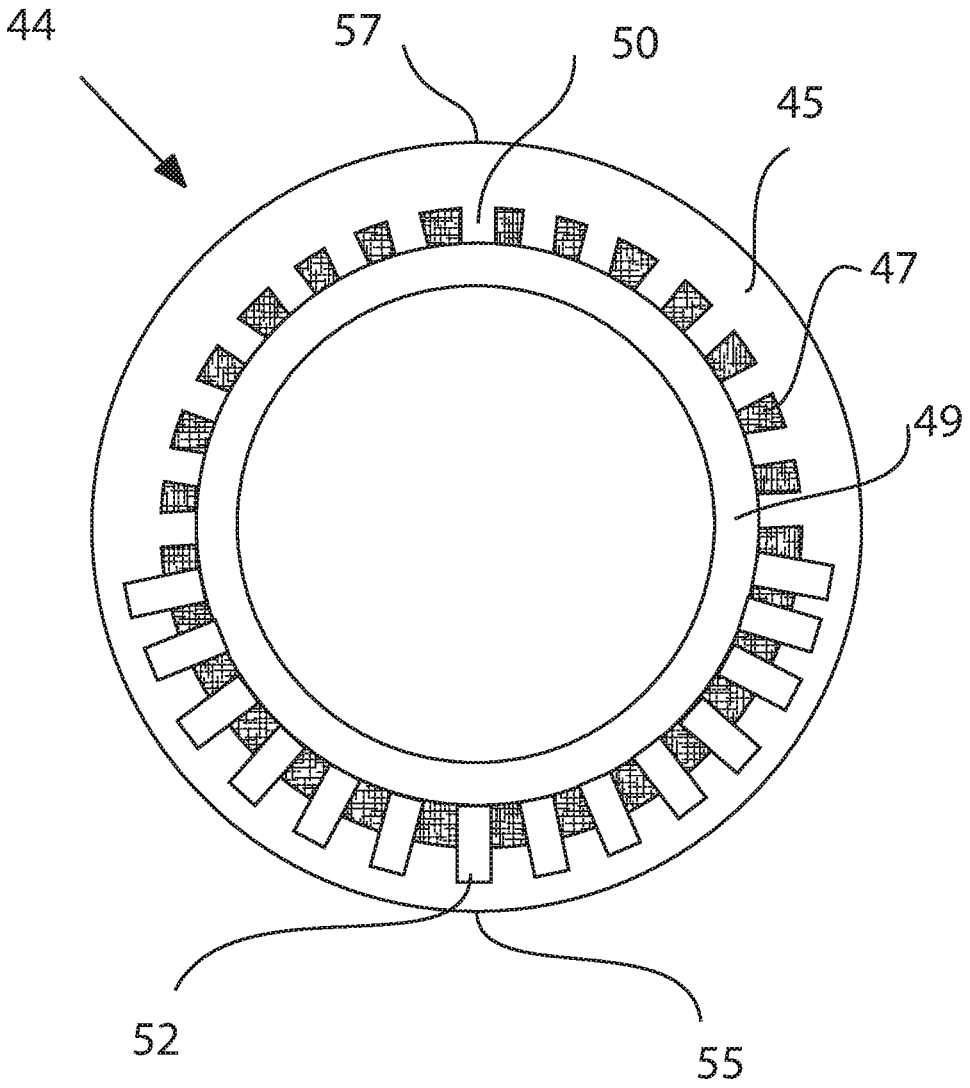
FIG. 6 illustrates a cross section view of a core and grip.

Referring to FIG. 6, a cross section of a golf club shaft, core and over molded rubber is shown at golf club grip 44. Golf shaft 49 has core 47 over it. Rubber 45 extends into slots of core 47 as seen by rubber extension 50. Alternatively, rubber adhesive materials, glues, rubber or the like fill core slots. When pressure is applied to the outside of grip 44 at point 57, rubber extension 50 presses downward and compresses onto shaft 49 providing better friction and adhesion to the shaft to prevent movement. Alternatively, other materials in addition to existing surrounding rubber 45 fill slots as seen with extensions 52 which compress onto shaft 49 when pressure is applied to point 55.

Figure 7:
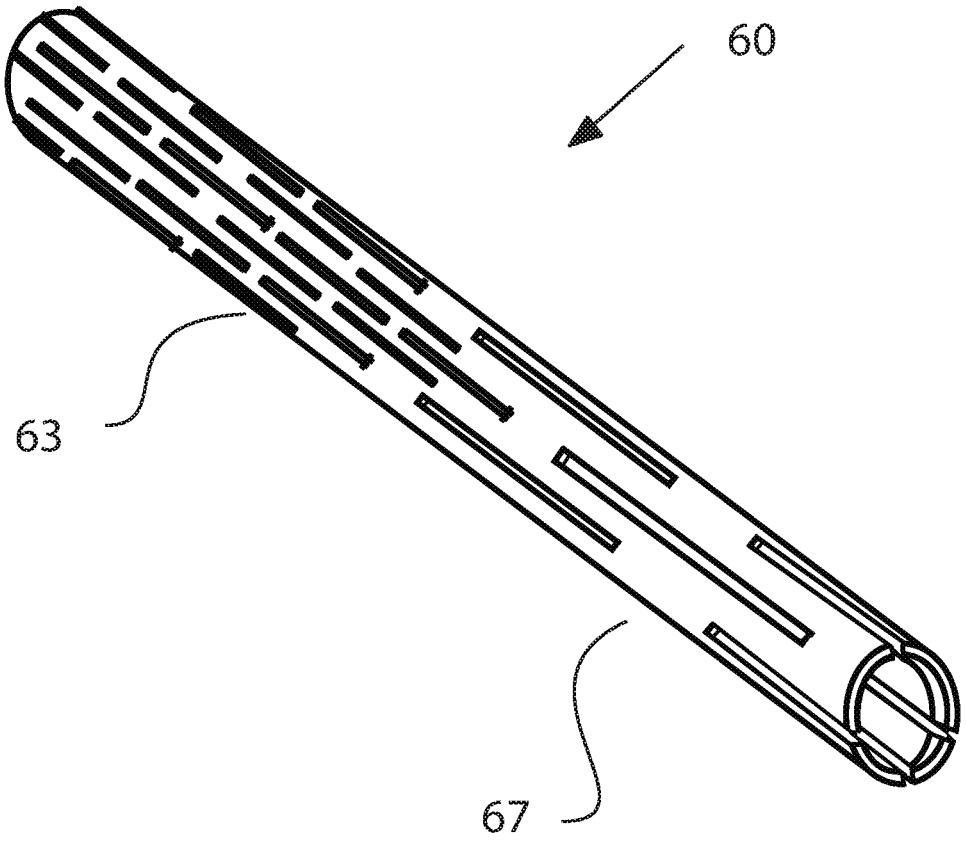
FIG. 7 illustrates an isometric view of a golf grip core.

Referring to FIG. 7, an alternative golf grip core 60 is shown. When golf grip core 60 is placed onto a golf shaft, end 67 requires a lot of expansion to fit over the end of a shaft and then adapt to the shaft when fully seated. The golf shaft is much wider at the end and narrower where the grip ends when fully seated. End 63 of golf grip core 60 requires a much smaller amount of expansion if any. For these reasons and to obtain a more secure grip, the pattern of slots is tighter at end 63 and looser at end 67.

Figure 8:
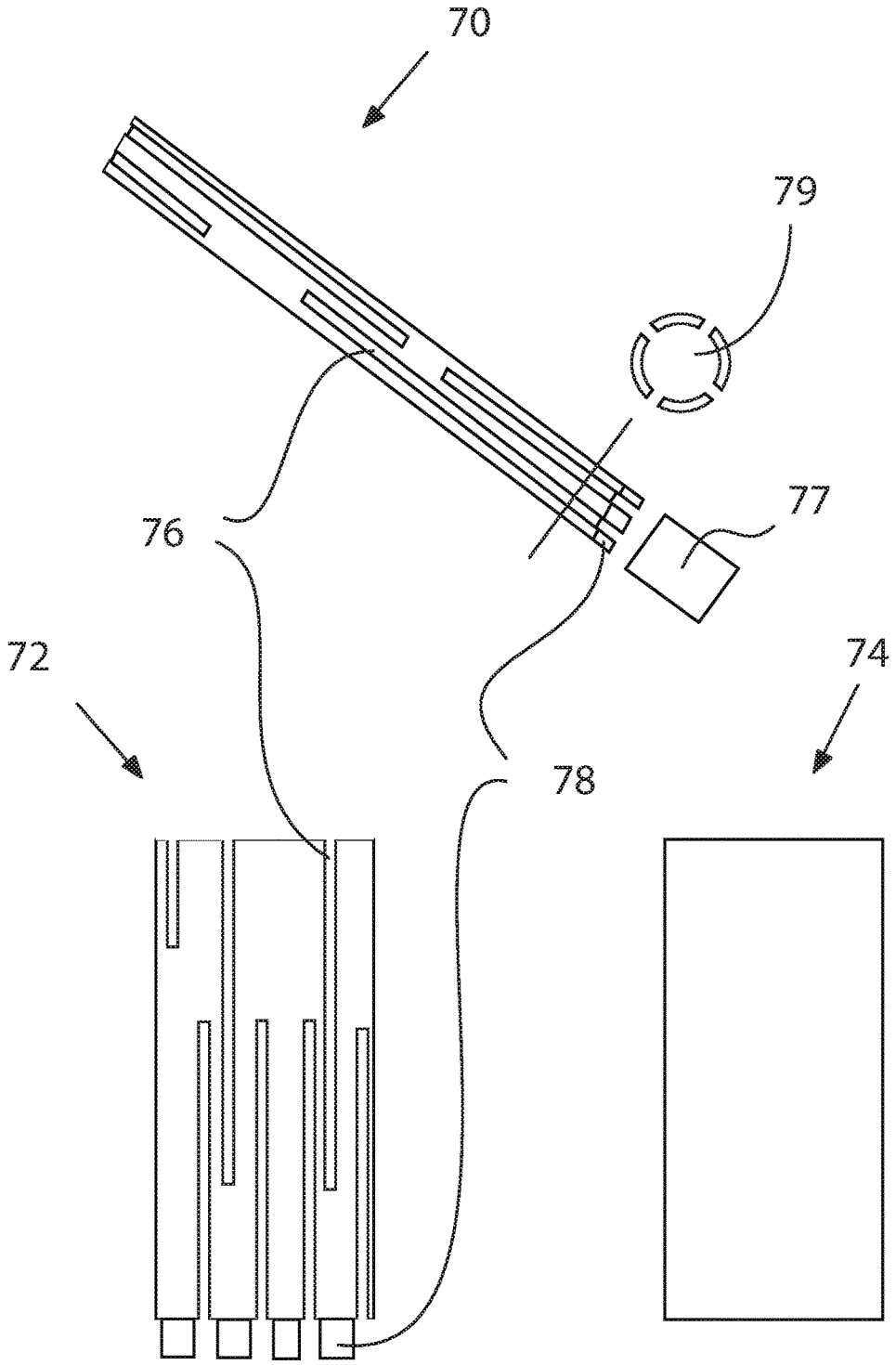
FIG. 8 illustrates an isometric view and a cross section view of an open and laid flat core with a rubber sheet.

Referring to FIG. 8, an alternative core 70 is shown in open and laid flat cross section 72. Slots 72 allow expansion. In the preferred embodiment, four slots start at the distal end to allow more even expansion over a shaft as seen in cross section 79 of core 70. Two or more upper slots extend downward and overlap the slots from the distal end. Extensions 78 provide a junction for rubber extension 77 to be placed. Rubber extension 77 provides stability at the core/grip end. Rubber extension expands over a shaft during placement and remains in compression when fully placed to resist lateral, rotational and other forces applied to a grip. Core 70 is shaped to reflect the resulting grip by taking a desired shape and reducing the thickness of rubber sheet 74 placed onto it. For example, rubber layer 74 is 0.08 inches thick. A core dimension is the final dimension of a grip minus the 0.08 inches in every outside dimension. If a grip is square, the core is square or if it is round, the core is round.

Figure 9:
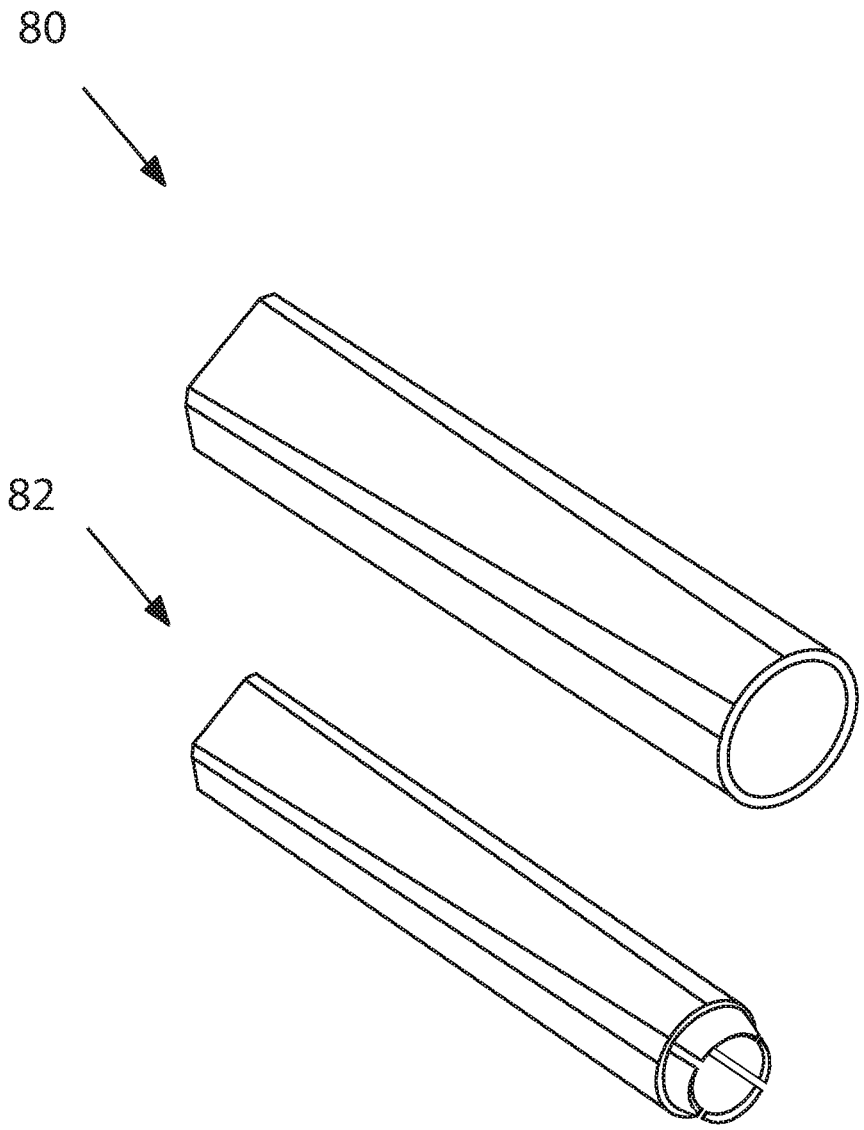
FIG. 9 illustrates an isometric view of a grip of this invention

Referring to FIG. 9, rubber grip 80 is placed onto core 82. Core 82 is a reduced version of rubber grip 80. The same general shape of core 82 allows even distribution of rubber on its surface placed either by placing an existing tube like structure, injection molding or adhering a thin sheet wrapped onto it. The advantage of using a core of this design is to maximize the amount of material to resist rotation and twisting. More cross section of material in the core provides more strength and easier manufacturing of the overall grip.

The invention claimed is:

1. A golf grip that includes:

an outer rubber component covering a core;

said core is positioned onto a golf club shaft;

said core comprises of an upper portion and a lower portion, said upper portion includes slots to allow expansion of said core onto a shaft, said lower portion includes slots designed to allow greater expansion than the amount of expansion of said upper portion.

2. The golf grip of claim 1, wherein said upper portion having a first inner diameter and said lower portion having a second inner diameter that somewhere throughout its length said lower portion inner diameter is less than said first inner diameter.

3. The golf grip of claim 1, that includes a compression unit.

4. The golf grip of claim 1, wherein said slots of said lower portion extend to an end of said lower portion.

5. The golf grip of claim 1 wherein said slots of said upper portion extend to an end of said upper portion.

6. The golf grip of claim 1, wherein an inner diameter of said upper portion is constant.

7. The golf grip of claim 1, wherein an inner diameter of said lower portion is tapered.

8. The golf grip of claim 1, wherein a rubber stabilizer is attached to a core end.

9. The golf grip of claim 8, wherein said rubber stabilizer extends outside said core.

10. The golf grip of claim 1, wherein an inside of said lower portion ends in a reverse taper.

11. The golf grip of claim 1, wherein said slots are parallel to a central lengthwise axis.

12. The golf grip of claim 1, wherein said slots are not parallel to a central lengthwise axis.

13. The golf grip of claim 1, wherein said slots are both parallel and not parallel to a central axis.

14. The golf grip of claim 1, wherein said outer rubber component covering is a thin rubber sheet.

15. The golf grip of claim 1, wherein said outer rubber component is molded directly onto said core.

16. The golf grip of claim 1, wherein said outer rubber component covering is manufactured as a separate unit and joined to said core.

17. The golf grip of claim 1, wherein said outer rubber component covering extends into said slots.

18. The golf grip of claim 1, wherein said slots have a separate rubber component or components placed into said slots.

* * * * *